United States Patent [19]

Muse

[11] 4,332,034

[45] Jun. 1, 1982

[54] GARMENT WAISTBAND STRUCTURES

[75] Inventor: Ralph F. Muse, Bremen, Ga.

[73] Assignee: Hubbard Company, Bremen, Ga.

[21] Appl. No.: 165,137

[22] Filed: Jul. 1, 1980

[51] Int. Cl.[3] ..... A41F 9/02

[52] U.S. Cl. ..... 2/237; 2/221

[58] Field of Search ..... 2/237, 221, 76, 236, 2/220, 227, 211

[56] References Cited

U.S. PATENT DOCUMENTS

| | | | |
|---|---|---|---|
| 2,195,894 | 4/1940 | Moore | 2/237 |
| 2,277,227 | 3/1942 | Hardie | 2/237 |
| 2,745,107 | 5/1956 | Gemignani | 2/236 |
| 2,757,381 | 8/1956 | Le Cottien et al. | 2/237 |
| 3,129,434 | 4/1964 | Weemhoff | 2/236 |
| 3,221,346 | 12/1965 | Johnson et al. | 2/236 |
| 3,422,461 | 1/1969 | Froehlich, Jr. | 2/236 |
| 3,427,661 | 2/1969 | Navasky | 2/236 |
| 3,559,213 | 2/1971 | Goodman | 2/237 |
| 3,723,993 | 4/1973 | Ruby | 2/237 |
| 3,800,332 | 4/1974 | Forrest | 2/237 |
| 3,869,728 | 3/1975 | Spencer | 2/221 |

*Primary Examiner*—H. Hampton Hunter

*Attorney, Agent, or Firm*—John S. Pratt

[57] ABSTRACT

A trousers waistband structure employing a two-part elastic band, an elastic reinforcement strip attached to the two-part elastic band such that the lower linear edge of the reinforcement strip depends freely from the band, and a linearly extensible waistband fabric web which is attached to the upper inside edge of the two-part elastic band, looped over the elastic band and reinforcement strip and attached, along its second linear edge, to the trousers body. The lower linear edge of the reinforcement strip is attached, by means of blind stitching proximate the seam between the trousers body and the waistband fabric web, to pockets previously inset in the trousers body.

12 Claims, 7 Drawing Figures

GARMENT WAISTBAND STRUCTURES

BACKGROUND OF THE INVENTION

1. The Field of the Invention

This invention pertains to a novel waistband structure employing a two-part elastic band for use in trousers or other garments.

2. Description of the Prior Art

Waistband structures for trousers and other garments employing elastic bands to provide a waistband sufficiently snug to support the garment are well known in the art.

One particularly successful elastic band structure is described in U.S. Pat. No. 2,757,381, issued to Yves le Cottier, et al ("Cottier"). Cottier discloses a two-part elastic band which has an upper portion contructed of an elastic fabric offering greater resistance to elongation than a lower portion of elastic fabric which offers less resistance to elongation. When the Cottier elastic band is employed in a waistband structure, the upper belt portion of the elastic band encircles the wearer's waist, providing a snug fit for the garment at the waist while the lower, skirt portion of the elastic band fits comfortably but snugly about the wearer's upper pelvic waist region, thereby providing snug but comfortable fit and support for trousers or other garments.

Waistband structures employing the Cottier elastic band and similar bands are known in the art, including the waistband structure disclosed by U.S. Pat. No. 3,723,993 to Ruby ("Ruby").

Ruby discloses a waistband structure achieved by stitching the Cottier elastic band to the inside face of a web of extensible fabric. The web of fabric is looped over the upper belt portion of the elastic band, its opposite edge is stitched to the trousers or other garment body and the web of fabric and trousers body are then stitched to the lower region of the upper waistband portion of the elastic band using top stitching proximate the seam between fabric web and trousers body. The waistband structure disclosed by Ruby presents relatively little resistance to rolling of the waistband, which is a frequent problem to wearers, particularly more corpulant individuals. The structure disclosed by Ruby requires the use of top stitching proximate the seam between waistband fabric web and trousers body, which top stitching is unsightly and difficult to install while maintaining a uniform line located a uniform distance from the seam between waistband fabric web and trousers body. Use of such top stitching is further a hindrance to construction of a desirable custom outlet at the rear seam between right and left garment sides.

It is therefore an object of the present invention to provide a garment waistband structure employing a two-part elastic band having an upper waistband portion more resistant to elongation and a lower skirt portion less resistant to elongation, which structure resists the tendency for garment waistbands to roll or otherwise deform in use and which waistband structure presents a highly attractive appearance and is easy to manufacture.

Other objects and advantages of the present invention will become apparent during the course of the following summary and description.

SUMMARY OF THE INVENTION

The objects of the invention are achieved by a garment waistband structure employing a two-part elastic band having an upper belt portion offering greater resistance to elongation and a lower skirt portion offering lesser resistance to elongation to which a reinforcement strip and waistband fabric web are initially stitched to opposite sides of the elastic band with stitching proximate the upper edge thereof. Said reinforcing strip is further attached to the elastic band, as for instance by a line of stitching near the middle of the reinforcing strip, such that a lower portion of the reinforcing strip remains free to serve as a sewing tab. The waistband fabric web is then looped over the top of the waistband structure and a line of stitching through the waistband fabric web, elastic band and reinforcing strip proximate the upper edge thereof may be added. The waistband fabric web is then sewn to the garment body, and the lower sewing tab portion of the reinforcing strip is blind stitched to the garment body or to the upper portion of inset pockets which have previously been attached to the garment body proximate the seam between the garment body and the waistband fabric web. This construction provides a very comfortable garment waistband structure with a waistband portion resistant to rolling, which is easy to construct and which has no outwardly visible stitching, thereby presenting a very clean and attractive appearance.

BRIEF DESCRIPTION OF THE DRAWINGS

The invention is now illustrated in detail by means of the drawings in which:

FIG. 7 is taken along 7—7 in FIG. 2.

DESCRIPTION OF PREFERRED EMBODIMENT

Figure 1:
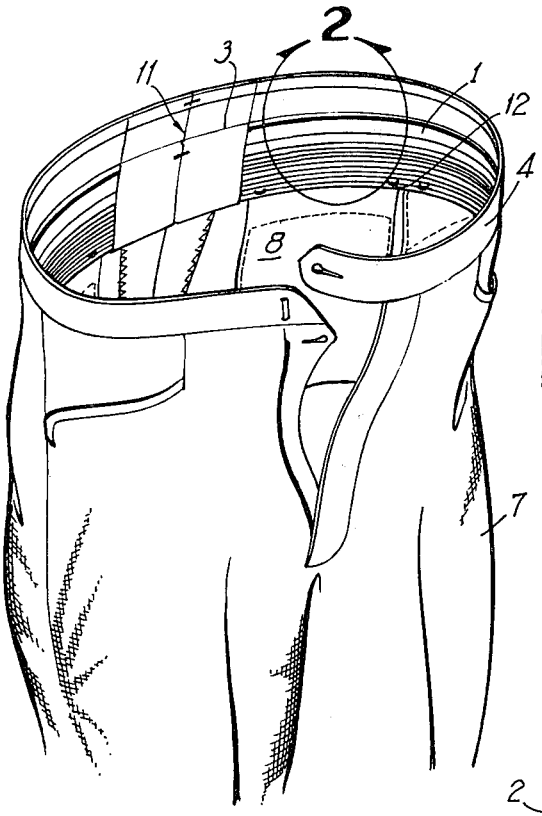
FIG. 1 is a perspective view of the upper portion of a garment embodying a waistband structure of the present invention.

Referring to the figures, FIG. 1 shows, in perspective, the upper portion of a garment embodying a waistband structure of the present invention in which two-part elastic band 1 is visible on the inside, and waistband fabric web 4 is visible on the outside, of the garment.

Figure 2:
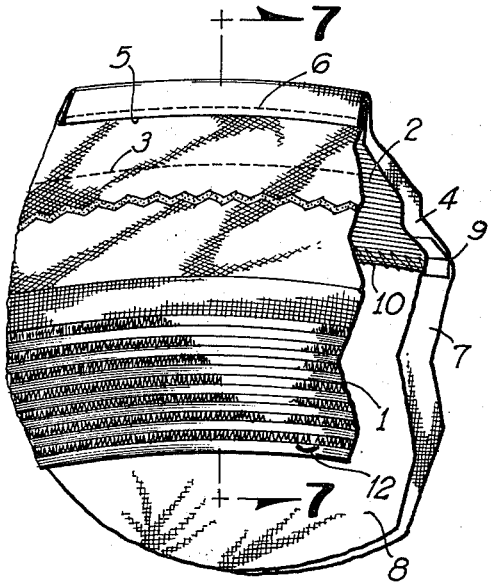
FIG. 2 is an enlarged inset perspective view of a portion of the waistband structure taken from inset circle 2 shown in FIG. 1 with portions of the structure cut away to show elements not otherwise visible.

FIG. 2 shows a portion of the waistband structure of the present invention viewed from the inside of the structure with portions of the structure cut away to show its construction. In FIG. 2 the outer face (away from the wearer) of the upper portion of the two-part elastic band 1 lies against and is attached to reinforcement strip 2, and the lower portion of two-part elastic band 1 lies against inset pocket 8 and depends freely from the upper portion of elastic band 2 except for optional blind tack stitching 12 through the lower edge of elastic band 1 into pocket 8. Waistband fabric web 4 and garment body 7 abut the outer faces of reinforcement strip 2 and pocket 8, respectively. Waistband fabric web 4, which is of a material which will stretch at least along the length thereof, is attached to the inside upper edge of elastic band 1 and folded over the top of said edge so that waistband fabric web 4 covers, and thereby finishes, the top edge of elastic band 1 and the contiguous top edge of reinforcement strip 2. Waistband fabric web 4 also covers the outside of reinforcement strip 2. The lower edge of reinforcement strip 2 is attached to pocket 8 and/or garment body 7 near the seam between waistband fabric web 4 and garment body 7 by means of a line of blind stitching 10.

Figure 3:
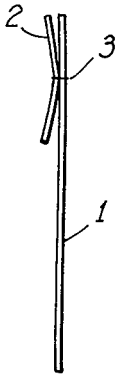
FIGS. 3 through 7 are schematic elevational cross sections of the waistband structure showing the preferred sequence of steps in constructing the waistband structure of the present invention.
Figure 4:
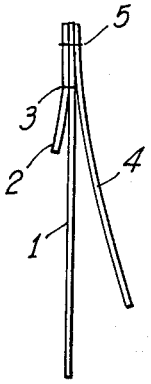
Figure 5:
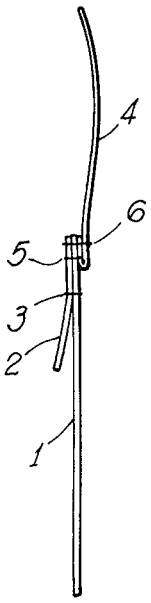
Figure 6:
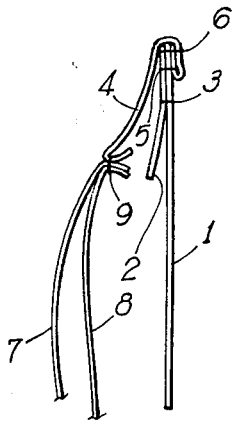
Figure 7:
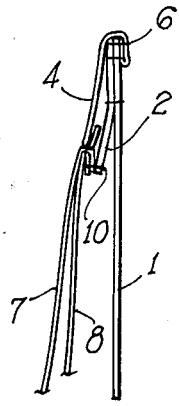

FIGS. 3 through 7 show the preferred sequence of steps in constructing the waistband structure of the present invention, although other sequences of steps may also be employed to construct the structure of the present invention. Referring to FIG. 3, a first line of stitching 3 near the central portion of reinforcement strip 2 is employed to attach reinforcement strip 2 to the outer face of two-part elastic band 1 such that the upper edge of reinforcement strip 2 is substantially even with the upper edge or belt portion edge of elastic band 1. Reinforcement strip 2 may alternatively be attached to elastic band 1 by any other convenient connecting means such as appropriate adhesives, so long as a lower linear portion of reinforcment strip 2 remains unattached to and depends freely from elastic band 1. Referring now to FIG. 4, waistband fabric web 4 is attached to the inside upper edge of elastic band 1, and the upper linear edge of reinforcement strip 2 is attached to elastic band 1, by a second line of stitching 5 passing through waistband fabric web 4 near one linear edge thereof, elastic band 1 and reinforcement strip 2. Waistband fabric web 4 may be further attached to elastic band 1 and reinforcement strip 2 by a line of top stitching 6 passing through waistband fabric web 4 after it has been folded up as shown in FIG. 5. Referring to FIG. 6, the second linear edge of waistband fabric web 4 is attached to garment body 7, shown with a previously attached inset pocket 8, by a line of third stitching 9 which passes through the free linear edge of waistband fabric web 4 and the upper edges of garment body 7 and inset pocket 8. Finally, referring to FIG. 7, the lower portion of reinforcement strip 2 is attached to garment body 7 and/or inset pocket 8 by a line of blind stitching 10.

Blind stitching 10 may be employed to attach reinforcement strip 2 to garment body 7 proximate the seam between garment body 7 and waistband fabric web 4 in garments having no inset pockets and between such pockets in garments which do have pockets. Alternatively, in garments having pockets, blind stitching 10 may be used to attach reinforcement strip 2 solely to pockets 8.

It is also advantageous to attach the lower edge of elastic band 1 to garment body 7 or to inset pockets 8 at intervals along elastic band 1 by means of blind tack stitching 12 shown in FIGS. 1 and 2.

The garment shown in FIG. 1 employs a custom outlet 11 at the rear seam of the garment. Other conventional outlet structures may also be employed and the waistband of the present invention could also be constructed in continuous form rather than with right and left halves as shown in FIG. 1.

The preferred embodiment of the present invention employs a conventional commercially available reinforcement strip 2 which is elastic and is made of nylon polymer, although other similar elastic reinforcement strips may also be used.

Although the present invention is described and illustrated above with detailed referenced to the preferred embodiment, the invention is not limited to the details of such embodiment but is capable of numerous modifications within the scope of the appended claims.

I claim:

1. A waistband structure for use in garments comprising:

(a) a two-part elastic band having an upper belt portion offering greater resistance to elongation and a lower skirt portion offering lesser resistance to elongation;

(b) a reinforcement strip attached by a first securing means to the outer face of the elastic band such that the upper linear edge of the reinforcement strip is substantially even with the belt portion edge of the elastic band and the lower linear edge depends freely from the elastic band; and (c) a waistband fabric web attached along one linear edge thereof by a second securing means to the inside face of the elastic band proximate the belt portion edge thereof.

2. A waistband structure according to claim 1, wherein said first securing means comprises a first line of stitching and said second securing means comprises a second line of stitching.

3. A waistband structure according to claim 2, wherein said reinforcement strip is elastic.

4. A waistband structure according to claim 3, wherein said waistband fabric web is linearly extensible.

5. A waistband structure according to claim 4, wherein the waistband fabric web is folded upward and a line of top stitching passes through two layers of the waistband fabric web, the elastic band and the reinforcement strip proximate the second line of stitching.

6. In combination, a garment comprising:

(a) a garment waistband structure comprising:

(i) a two-part elastic band having an upper belt portion offering greater resistance to elongation and a lower skirt portion offering lesser resistance to elongation;

(ii) a reinforcement strip attached by first securing means to the outer face of the elastic band such that the upper linear edge of the reinforcement strip is substantially even with the belt portion edge of the elastic band and the lower linear edge depends freely from the elastic band; and (iii) a waistband fabric web attached along a first linear edge thereof by a second securing means to the inside face of the elastic band proximate the belt portion edge thereof; and (b) a garment body attached proximate the upper linear edge thereof by third securing means to the second linear edge of the waistband fabric web and to the lower linear edge of the reinforcement strip by fourth securing means.

7. A garment according to claim 6, wherein said first, second and third securing means comprise a first, a second and a third line of stitching, respectively.

8. A garment according to claim 7, wherein said fourth securing means comprises a line of blind stitching.

9. A garment according to claim 8, wherein said reinforcement strip is elastic.

10. A garment according to claim 9, wherein said waistband web is linearly extensible.

11. A garment according to claim 10, wherein the waistband fabric web is folded upward and a line of top stitching passes through two layers of the waistband fabric web, the elastic band and the reinforcement strip proximate the second line of stitching.

12. In combination, trousers comprising:

(a) a waistband structure comprising:

(i) a two-part elastic band having an upper belt portion offering greater resistance to elongation and a lower skirt portion offering lesser resistance to elongation;

(ii) an elastic reinforcement strip attached by a line of stitching to the outer face of the elastic band such that the upper linear edge of the reinforcement strip is substantially even with the belt portion edge of the elastic band and the lower linear edge depends freely from the elastic band; and (iii) a linearly extensible waistband fabric web attached along a first linear edge thereof by at least one line of stitching to the inside face of the elastic band at the belt portion edge thereof; and (b) a trousers body with inset pockets which body is attached proximate the upper linear edge thereof by a line of stitching to the second linear edge of the waistband fabric web and to the lower linear edge of the reinforcement strip by blind stitching passing through the reinforcement strip and into the pockets.

* * * * *